United States Patent [19]

Betterley

[11] 4,300,297

[45] Nov. 17, 1981

[54] TICKET

[75] Inventor: James E. Betterley, Huntingdon Valley, Pa.

[73] Assignee: Globe Ticket Company, Horsham, Pa.

[21] Appl. No.: 771,908

[22] Filed: Feb. 25, 1977

[51] Int. Cl.[3] ..... G09F 3/04

[52] U.S. Cl. ..... 40/20 R

[58] Field of Search ..... 40/2 R, 21 R, 21 C, 40/20 R; 283/18; 156/227

[56] References Cited

U.S. PATENT DOCUMENTS

| | | | |
|---|---|---|---|
| 1,452,460 | 4/1923 | Hart | 40/21 R |
| 1,723,873 | 8/1929 | Lowy | 40/21 R |
| 2,578,548 | 12/1951 | Histed | 40/21 R |
| 3,130,509 | 4/1964 | Brooks | 40/21 R |
| 3,227,268 | 1/1966 | Gringer | 40/2 R X |
| 3,933,560 | 1/1976 | Muttera | 40/20 A X |

FOREIGN PATENT DOCUMENTS

| | | | |
|---|---|---|---|
| 190860 | 8/1937 | Switzerland | 40/2 R |
| 1384428 | 2/1975 | United Kingdom | 40/2 R |

*Primary Examiner*—Harland S. Skogquist

*Attorney, Agent, or Firm*—Harding, Earley & Follmer

[57] ABSTRACT

A self-wicketing ticket is provided by a tag, one side of which is coated with a pressure sensitive coating covered by a backing, the backing being removable to expose the pressure sensitive coating, and means on said tag to provide a wicket. The wicket providing means comprises either a strip portion formed on the tag or a cord attached to the tag at a hole near an edge thereof.

1 Claim, 8 Drawing Figures

TICKET

BACKGROUND AND SUMMARY OF THE INVENTION

The tickets used at ski areas to identify skiers (and in other similar applications) have been fastened to the skier's clothing by means of a ticket wicket. This was done initially by means of a steel wire which had a tag stapled to it. The purpose of the wicket is to provide a hanger which can be put through a portion of the skier's clothing such as belt loop, button hole or zipper pull. The tag is fastened over the wicket to make a tamper detectible, non-switchable seal so that the ticket cannot be reused by taking it from the place of attachment on the original user and attaching it to another person's clothing.

However, the above-described wickets were not entirely satisfactory because they presented the danger of injury in case of a fall during which the sharp edges of the wicket could severely injure the skier. This led to the use of a pipe cleaner or fiber covered wire. More recently, plastic wickets have been introduced such as those shown and described in U.S. Pat. No. 3,933,560.

It is the general object of this invention to provide a ticket of the indicated type which is designed to be a self-wicketing ticket which is inexpensive to manufacture and easy to assemble and install. In one form of self-wicketing ticket in accordance with the invention, a tag is coated on one surface with a pressure sensitive adhesive and is provided with a backing cover for the pressure sensitive adhesive which backing is removable from the tag to expose the pressure sensitive adhesive, and a strip is formed as a portion of the tag which can be utilized to provide the wicket for the tag.

In accordance with another form of the invenion, the pressure sensitive tag is provided with a cord secured to the tag at a hole near one edge thereof and this cord serves as the wicket.

The self-wicketing ticket in accordance with the invention is inexpensive to manufacture as compared with the prior art wickets. Moreover, the self-wicketing ticket of the invention avoids the necessity for time consuming assembly of a wicket onto the ticket and is easy to attach onto the skier's clothing.

DETAILED DESCRIPTION OF THE PREFERRED EMBODIMENTS

Figure 1:
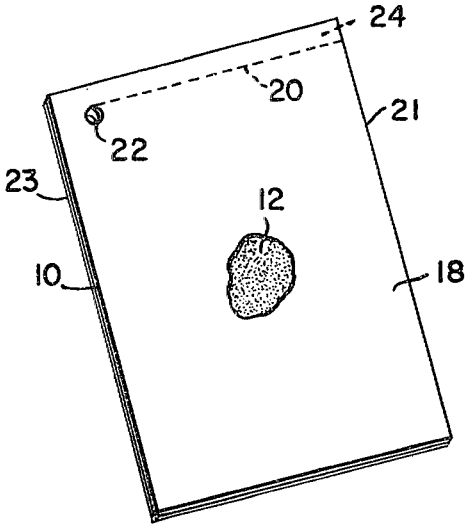
FIG. 1 is a view showing a ticket in accordance with the invention.

In FIG. 1 there is shown a ticket in accordance with the invention which comprises a rectangular tag 10 having a coating 12 of a pressure sensitive adhesive on one side 14 thereof. The tag 10 is preferably made of a plastic vinyl which provides sufficient strength to resist tampering in the assembled condition of the ticket as will be described hereafter. The other side 16 of the tag 10 is provided with suitable ticket markings such as the word "ADULT" (see FIG. 4). In the case of a ski ticket, the ticket markings would also generally indicate the name of the ski area and be provided with suitable color coding.

The ticket also includes a backing 18 which covers the adhesive coating 12, the backing 18 being removable therefrom as is conventional in the art to expose the pressure sensitive adhesive.

In accordance with a novel feature of the invention, the tag 10 is provided with means for providing a wicket for the ticket. To this end, the tag 10 is provided with a slit 20 extending along and spaced from the top edge of the tag 10. The slit 20 extends from the side edge 21 of the tag 10 to a hole 22 adjacent the side edge 23 of the tag 10.

The slit construction described above provides a ticket wicket 24 in the form of an elongated tab or strip which may be extended from the tag 10 for looping into an article of clothing for attachment thereto. Thus, the ticket in accordance with the invention may be said to be a self-wicketing ticket. The termination of the slit 20 at hole 22 provides a tear resistant end for the slit 20 to prevent the tearing of the wicket 24 from the tag 10.

Figure 2:
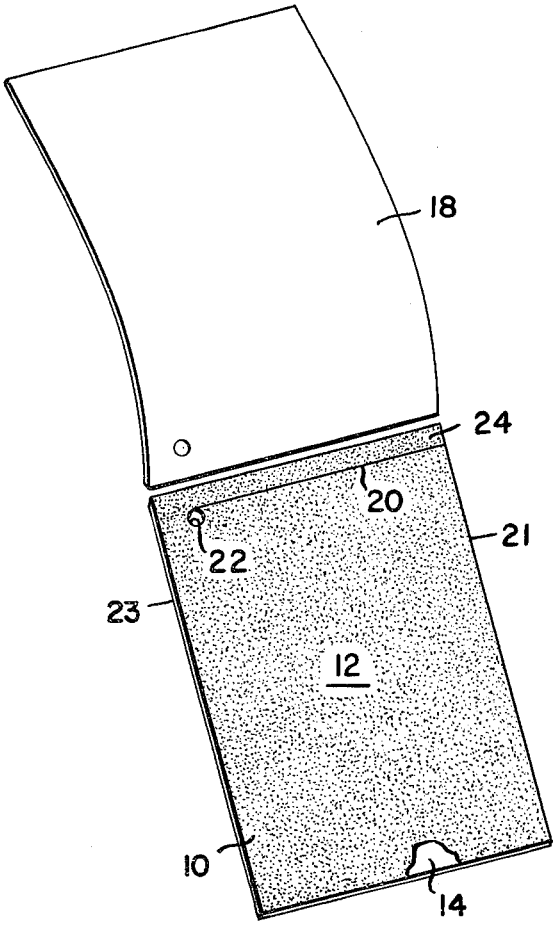
FIGS. 2, 3 and 4 are views showing successive steps of a method of attaching the ticket of FIG. 1 to a zipper pull.
Figure 3:
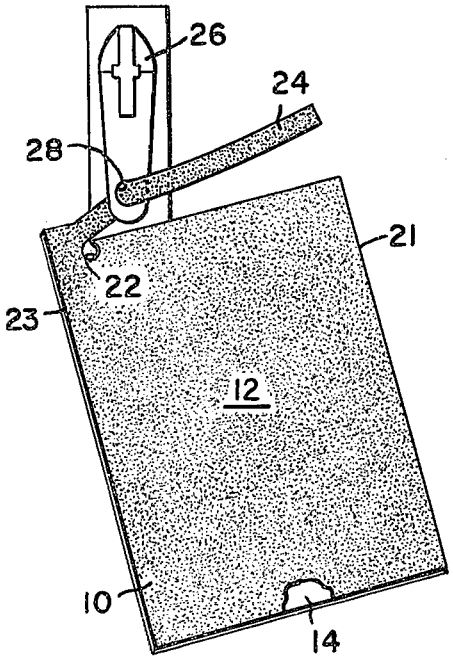
Figure 4:
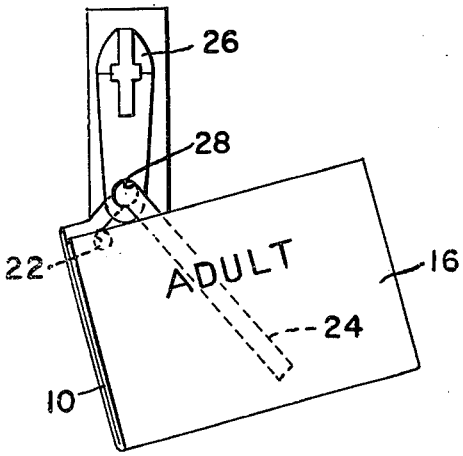

The method of attaching the ticket shown in FIG. 1 to an article of clothing is illustrated in FIGS. 2, 3 and 4. The first step in this method is to remove the backing 18 from the tag 10 to expose the pressure sensitive adhesive 12. This is achieved by pulling the backing from the tag 10 as is illustrated in FIG. 2.

The next step in the method is to loop the wicket 24 around a part of the skier's clothing such as the zipper pull 26 shown in FIG. 3. The wicket 24 is inserted into the hole 28 in the zipper pull 26 to the full extent possible. The portion of the wicket 24 extending through the hole 28 in the zipper pull 26 is placed in contact with the pressure sensitive adhesive 12.

The final step in the method is to fold together opposed portions of the pressure sensitive tag 10 to enclose the wicket 24 therebetween. The final condition of the ticket as attached to the zipper pull 26 is illustrated in FIG. 4.

Figure 5:
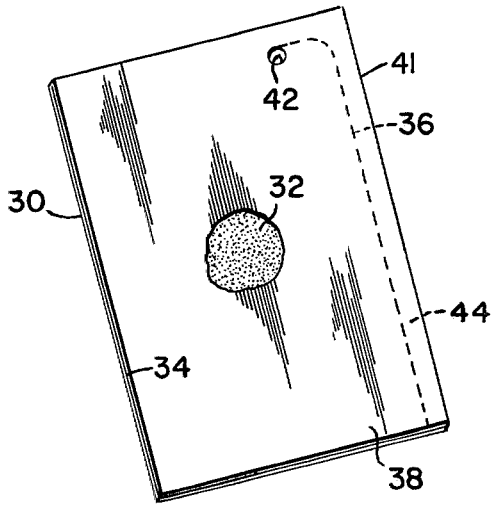
FIG. 5 is a view showing a second form of ticket in accordance with the invention.

In FIG. 5, there is shown a second form of ticket in accordance with the invention which comprises a rectangular tag 30 having a coating 32 of pressure sensitive adhesive on one side 34 thereof. The tag 30 is preferably of a plastic vinyl and is otherwise similar to the tag 10 in that suitable ticket markings are provided on its other side opposite the side 34. The ticket of FIG. 5 also includes a backing 38 which covers the adhesive coating 32, the backing 38 being removable as is conventional in the art.

The ticket of FIG. 5 differs from the ticket of FIG. 1 in the form of wicket providing means used. In FIG. 5, the wicket providing means is formed by a slit 36 extending from the bottom edge of the tag 30 along the side edge 41 thereof and turning inwardly along the top edge to terminate at a hole 42 adjacent to the top edge. The termination of the slit 42 at the hole 40 provides a tear resistant end for the slit 42.

It will be apparent that the slit construction described above provides a ticket wicket 44 in the form of an elongated tab or strip which may be extended from the tag 30 for looping into an article of clothing for attachment thereto.

Figure 6:
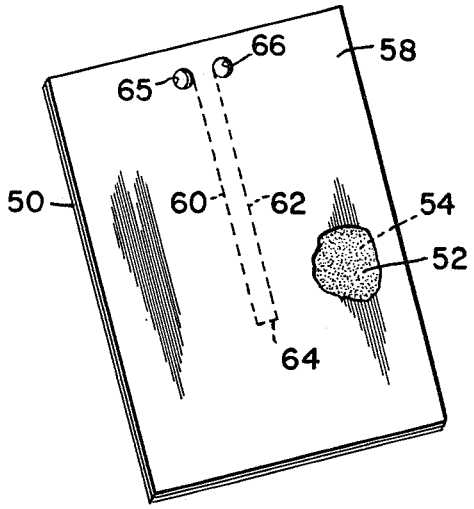
FIG. 6 is a view showing a third form of ticket in accordance with the invention.

In FIG. 6, there is shown a third form of ticket in accordance with the invention which comprises a rectangular tag 50 having a coating 52 of pressure sensitive adhesive on one side 54 thereof, the tag 50 being preferably made of a plastic vinyl. The other side of the tag 50 opposite side 54 is provided with suitable ticket markings and the ticket of FIG. 6 is otherwise similar to the ticket of FIG. 1. The ticket of FIG. 6 also includes a backing 58 which covers the adhesive coating 52, the backing being removable from the tag 50 as is conventional in the art.

The ticket of FIG. 6 differs from the ticket of FIG. 1 in the form of the wicket providing means. In FIG. 6, the wicket providing means is comprised of a pair of spaced parallel slits 60 and 62 joined at one end by a transverse slit 64 and terminating at the other end at a pair of holes 65 and 66 near the top edge of the ticket 50. The termination of the slits 60 and 62 at the holes 65 and 66 provides a tear resistant end for these slits 60 and 62.

The slit construction provides a ticket wicket 64 in the form of an elongated tab or strip which may be extended from the tab 50 for looping into an article of clothing for attachment thereto. The wicket 64 is an internal tab or strip as compared with the edge strips of the embodiments of the invention shown in FIGS. 1 and 5.

Figure 7:
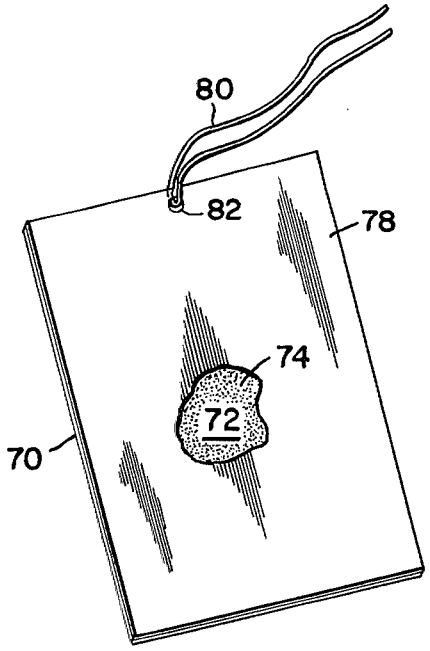
FIG. 7 is a view showing a fourth form of ticket in accordance with the invention.

In FIG. 7, there is shown a fourth form of ticket in accordance with the invention which comprises a rectangular tag 70 having a coating 72 of pressure sensitive adhesive on one side 74 thereof, the tag being preferably made of a plasitc vinyl. The other side 76 of the tag 70 is provided with suitable ticket markings. The ticket of FIG. 7 also includes a backing 78 which covers the adhesive coating 72, the backing 78 being removable from the tag 70.

Figure 8:
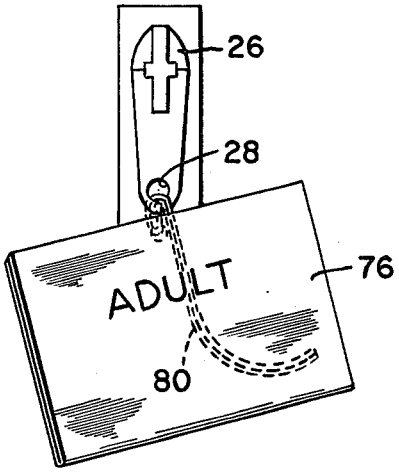
FIG. 8 is a view showing the ticket of FIG. 7 attached to a zipper pull.

The ticket of FIG. 7 differs from the ticket of FIG. 1 in the form of the wicket providing means. In FIG. 7 the wicket providing means is comprised of a cord 80 which is secured to the tag 70 at a hole 82 near the upper edge thereof as is apparent from FIG. 7. The cord 80 provides a ticket wicket which may be extended from the ticket for looping into an article of clothing for attachment thereto. In FIG. 8, the cord 80 is shown as attached to a zipper pull 26.

The cord 80 may be made of a typical cloth-type string or it may be made out of nylon such as fishing line to provide additional strength. Also, the cord 80 may be made of wire or an elastic string, such as the cloth covered rubber strings in common use. An elastic cord 80 is more difficult to tamper with since it will shrink when cut making re-tying almost impossible.

It is noted that in attaching the ticket of FIG. 7 to an article of clothing it is important to seal over the hole 82 where the cord 80 is attached to the tag 70. This makes it harder to spread apart the tag 70 and cut it at this point for resealing as might be tried by someone attempting to transfer the ticket. By enclosing as much of the cord-type wicket as possible as is shown in FIG. 8, the ticket becomes tamper detectible. Also, by reason of the folding the tag 70 over the hole 82, there is provided a reinforcement at this hole 82 which, in effect, is a self-patching function.

I claim:

1. A self-wicketing ticket comprising:

a tag, one surface of which is coated with a pressure sensitive adhesive, a backing covering said pressure sensitive adhesive and adapted to be separated from said tag to expose said pressure sensitive adhesive, means on said tag for providing a wicket for said ticket, said wicket providing means comprising a strip portion of said tag, said strip portion being formed by a slit in the tag spaced from and extending along an edge of said tag, and a hole formed in said tag, said slit extending from an edge of said tag to said hole.

* * * * *